US010793344B2

(12) United States Patent
Weissbrod

(10) Patent No.: US 10,793,344 B2
(45) Date of Patent: Oct. 6, 2020

(54) HERMETICALLY SEALED POUCH FOR ELONGATED OBJECTS

(71) Applicant: LINCOLN GLOBAL, INC., Santa Fe Springs, CA (US)

(72) Inventor: Paul A. Weissbrod, South Euclid, OH (US)

(73) Assignee: LINCOLN GLOBAL, INC., City of Industry, CA (US)

( * ) Notice: Subject to any disclaimer, the term of this patent is extended or adjusted under 35 U.S.C. 154(b) by 0 days.

(21) Appl. No.: 16/272,007

(22) Filed: Feb. 11, 2019

(65) Prior Publication Data

US 2019/0308799 A1 Oct. 10, 2019

Related U.S. Application Data

(60) Provisional application No. 62/653,730, filed on Apr. 6, 2018.

(51) Int. Cl.

| | |
|---|---|
| ***B65D 85/26*** | (2006.01) |
| ***B65D 75/54*** | (2006.01) |
| ***B65D 75/52*** | (2006.01) |
| ***B65D 75/30*** | (2006.01) |

(52) U.S. Cl.

CPC ..... *B65D 85/26* (2013.01); *B65D 75/30* (2013.01); *B65D 75/527* (2013.01); *B65D 75/54* (2013.01)

(58) Field of Classification Search

CPC ..... B65D 75/30; B65D 75/52; B65D 75/527; B65D 75/54; B65D 85/26; B65D 30/00; B65D 77/10; B65D 81/26

USPC ..... 493/186–268

See application file for complete search history.

(56) References Cited

U.S. PATENT DOCUMENTS 3,350,535 A 10/1967 Simon
3,358,821 A * 12/1967 Weisberg ..... B65D 75/42 383/37
3,715,856 A * 2/1973 Borel ..... B65B 7/2871 206/459.5

(Continued)

FOREIGN PATENT DOCUMENTS

CN 104416994 3/2015
DE 3800551 7/1989

(Continued)

OTHER PUBLICATIONS

SIJ Elektrode; 3 pages; Welding Electrodes packed in to new Vacuum Foil; Sep. 10, 2015; Cesta zelezarjev 8, 4270 Jesenice, Slovenija.

(Continued)

*Primary Examiner* — Bryon P Gehman
(74) *Attorney, Agent, or Firm* — Tucker Ellis LLP

(57) ABSTRACT

The invention described herein generally pertains to a hermetically sealed pouch for storing elongated objects. The pouch includes a plurality of pockets separated by longitudinal seals that are also perforated. A bundle of elongated objects to be inserted into an individual pocket of the pouch can be provided with caps on each end to protect a material of the pouch. The pouch can be provided with a label having a plurality of sections that each align with a corresponding pocket of the pouch. The label can include perforations between each section, which are aligned with perforations along the longitudinal seals of the pouch.

14 Claims, 7 Drawing Sheets

(56) References Cited

U.S. PATENT DOCUMENTS

| | | | | |
|---|---|---|---|---|
| 4,497,407 | A | 2/1985 | Stager | |
| 4,589,550 | A | 5/1986 | Stager | |
| 4,840,831 | A | 6/1989 | Smitweld | |
| 5,266,772 | A | 11/1993 | Reed | |
| 6,048,640 | A | 4/2000 | Walters et al. | |
| 6,874,621 | B2 * | 4/2005 | Solosko | A61B 5/0408 206/701 |
| 7,780,004 | B2 | 8/2010 | Carlozzi et al. | |
| 2005/0261659 | A1 * | 11/2005 | Mizuo | A61J 1/10 383/37 |
| 2006/0233467 | A1 * | 10/2006 | Mize | B65D 31/00 383/37 |

FOREIGN PATENT DOCUMENTS

| | | |
|---|---|---|
| EP | 2168889 | 3/2010 |
| GB | 1066875 | 4/1967 |
| RU | 50515 | 1/2006 |

OTHER PUBLICATIONS

Merkandi.com; ESAB, ELGA and other Welding Electrodes Total 352.8kg; Oct. 15, 2019; https://merkandi.com/archive/esab-elga-and-other-welding-electrodes-total-352-8kg/148652.

Etra Oy Products; 2 pages; Etra 2012-2018/ Y:01078010 https://www.etra.fi/en/welding-e120/welding-equipments-e1201/other-welding-accessories-and-tools-e120116/mig-pliers-fix2-10120001293.

White welding Electrode, 2.5 mm/3.2mm/4.0mm, AWS E6013/E7018 carbon steel type;3 pages; Global Sources; Copyright 2019 Publishers Representatives Limited. Oct. 16, 2019; https://www.globalsources.com/gsol/I/Welding-electrode/p/sm/1127720988.htm#1127720988.

Cigweld Pty Ltd—Ferrocraft 22 3.2mm Electrode/Product Safety Australia; Jan. 11, 2017; 2 pages; https://www.productsafety.gov.au/recall/cigweld-pty-ltd-ferrocraft-22-32-mm-electrode.

Gasweld Welding and Engineering Supplies; Eurotord 7018 Vacuum Packed Electrodes; https://www.gasweld.ie/product/eurotord-7018-vacuum-packed-electrodes/.

Airgas an Air Liquide Company 3/32'×36" ER70S-2 Radnor 70S-2 Carbon Steel TIG Rod 1 lb. Tube; 2019 Airgas, Inc. All rights Reserved. 2 pages; https://www.airgas.com/product/Welding-Products/Filler-Metal/TIG-Rod-(GTAW)/TIG-Rod---Carbon-Steel/p/RAD64001645.

BOC ProFill Nickelcoat Gas Welding Rod: 2.5kg; BOC, a Member of the Linde Group; Copyright BOC 2019; 4 pages. https://www.boc.com.au/shop/en/au/boc-profill-nickelcoat-gas-welding-rod-grnc-25.

ARC-ZONE.com; ER316I—Stainless steel TIG Welding rod—1lb. Pack; 3 pages; Copyright 2019 Arc-Zone.com, Inc. https://www.arc-zone.com/stainless-steel-tig-rod-er-316I.

* cited by examiner

HERMETICALLY SEALED POUCH FOR ELONGATED OBJECTS

CROSS REFERENCE TO RELATED APPLICATIONS

This application claims the benefit of and priority to U.S. Provisional Application Ser. No. 62/653,730, filed on Apr. 6, 2018. The entirety of this application is incorporated herein by reference.

TECHNICAL FIELD

In general, the present invention relates to packaging for elongated objects and, in particular, a hermetically sealed pouch for elongated objects.

BACKGROUND OF THE INVENTION

In arc welding, electrode material may be melted and deposited to a joint. One type of consumable electrode is a stick or rod electrode. Stick electrodes are often transported from a manufacturer to a consumer in a sealed container, such as a can. Stick electrodes can absorb moisture when exposed to the atmosphere. The absorbed moisture can lead to poor weld quality. Accordingly, the container for the electrodes typically arrives from a factory hermetically sealed.

After the container is opened, the hermetic seal is broken and the electrodes remain exposed to atmospheric moisture. A rod oven can be used to reduce, prevent, or reverse the absorption of moisture by the stick electrodes. Rod ovens, however, may not be able to restore the stick electrodes to an original condition. Further, stick electrodes may be stored at a central location (e.g. a material crib) to be issued to a welder as needed. Accordingly, the stick electrodes remain exposed while the welder travels to a weld site.

SUMMARY OF THE INVENTION

In accordance with an embodiment of the present invention, a hermetically sealed pouch for storing elongated objects can include a plurality of pockets separated by longitudinal seals. Each longitudinal seal between adjacent pockets is perforated to enable separation of individual pockets from an integral pouch. Each pocket can contain a portion of the elongated objects stored by the pouch. By separation of a pocket from the pouch, the associated portion of objects can be dispensed without compromising the hermetic seal of the remaining pockets of the pouch. A bundle of elongated objects in an individual pocket of the pouch can be provided with caps on each end. The caps protect a material of the pouch from the ends of the bundle, which can damage the material and compromise the hermetic seal.

The pouch can be provided with a label on at least one side. The label can have a plurality of sections such that, when applied to the pouch, each section aligns with a corresponding pocket of the pouch. The label can include perforations between each section, which can align with the perforations along the longitudinal seals of the pouch. Accordingly, when an individual pocket is separated from the pouch, a section of the label also detaches and remains applied to the removed pocket.

These and other objects of this invention will be evident when viewed in light of the drawings, detailed description and appended claims.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof, and wherein.

DETAILED DESCRIPTION OF THE INVENTION

Figure 1:
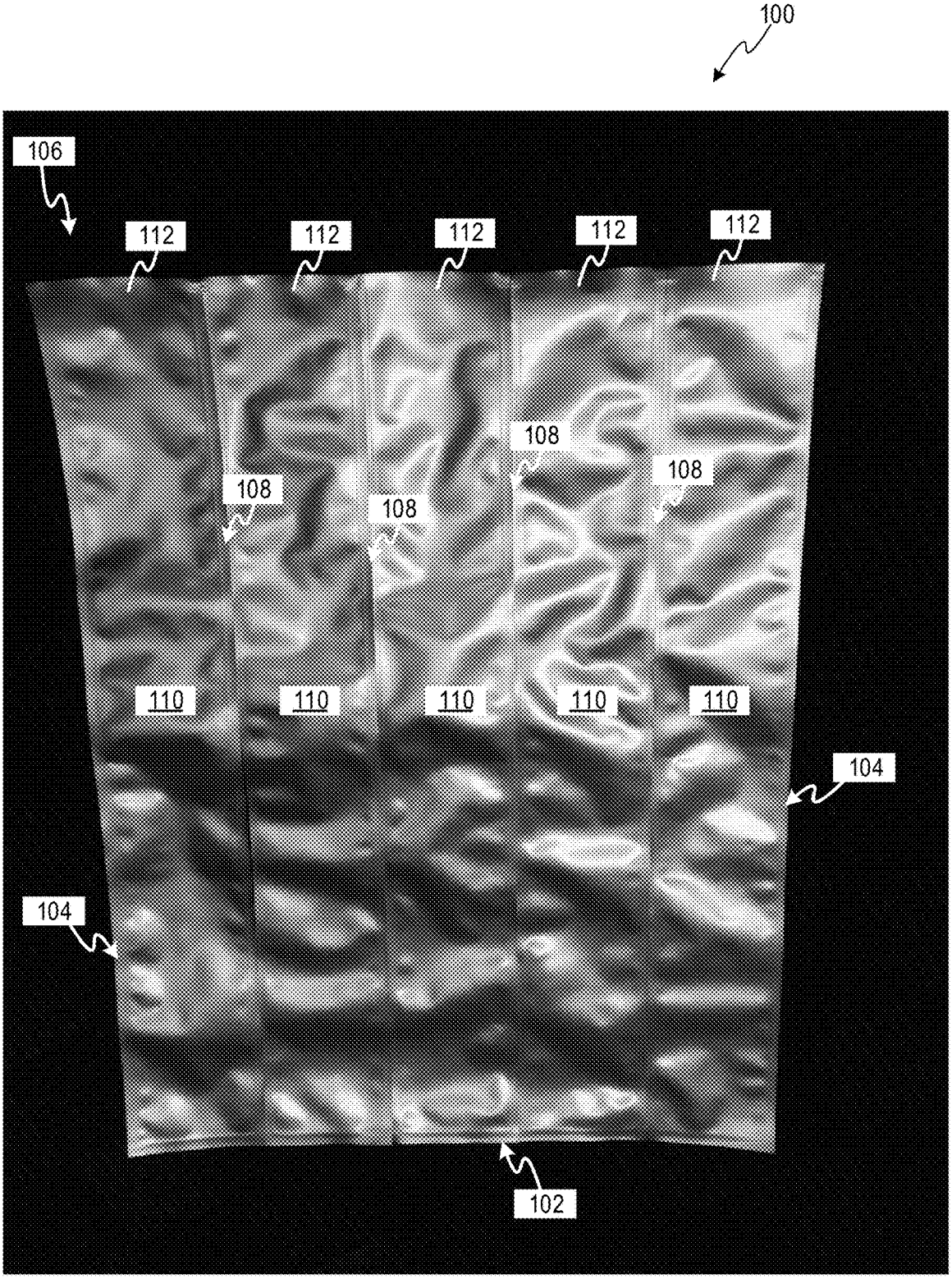
FIG. 1 illustrates an exemplary, non-limiting embodiment of a pouch for storing elongated objects according to one aspect.

Embodiments of the invention relate an apparatus to contain hermetically sealed elongated objects (e.g. stick electrodes) and to provide for portioned dispensation of some objects without compromising a seal of remaining items. The apparatus includes a foil laminate material formed into a pouch or master body. A set of longitudinal seals are formed in a spaced arrangement on the pouch to define a plurality of pockets. Each pocket can accommodate a portion or bundle of elongated objects received therein. The pouch, after product is inserted into each pocket, can be hermetically sealed as a unit such that each pocket is also sealed. The longitudinal seals that define and separate the plurality of pockets may be perforated to enable easy separation of an individual pocket from the whole.

In accordance with one or more aspects, caps are placed on the bundle of elongated objects before insertion into a pocket. In particular, the caps are placed to cover the ends of the bundle of the elongated objects. The ends of the objects can damage the foil laminate of the pouch and compromise the hermetic seal. The caps protect the pouch from such damage while also providing a transition from an expanded body portion of each pocket to the sealed area of the pouch.

In accordance with another aspect, a label is applied to the pouch. The label can include a plurality of sections divided by perforations. When applied to the pouch, each section generally aligns with a corresponding pocket. Moreover, the perforations of the label generally align with the perforations along the longitudinal seals. Accordingly, when an individual pocket is separated from the whole, a section of the label is also separated and remains affixed to the separated pocket.

The best mode for carrying out the invention will now be described for the purposes of illustrating the best mode known to the applicant at the time of the filing of this patent application. The examples and figures are illustrative only and not meant to limit the invention, which is measured by the scope and spirit of the claims.

Referring now to the drawings, wherein the showings are for the purpose of illustrating an exemplary embodiment of the invention only and not for the purpose of limiting same, FIGS. 1-7 illustrate an apparatus for storing elongated objects that have been hermetically sealed.

Turning initially to FIG. 1, an exemplary, non-limiting embodiment of a pouch 100 is depicted having a bottom seal 102, a pair of side seals 104, and a top end 106 that may be unsealed and open initially. Pouch 100 can be formed with two sheets of a foil laminate material that are joined and sealed along three edges (e.g. by seals 102, 104). A series of longitudinal seals 108 can be formed in the pouch 100 to define a plurality of individual pockets 110. The longitudinal seals 108 can extend between a bottom seal 102 and a top end 106 of the pouch 100 and be spaced at intervals between the side seals 104. The longitudinal seals 108 can include perforations to enable separation of one or more pockets 110 from pouch 100 without disrupting an integrity of the hermetic seals of any other pocket 110. As shown in FIG. 1, each pocket 110 includes an opening 112 at the top end 106 of the pouch 100 for receiving elongated objects for storage. After product is inserted into the pockets 110, the openings 112 can be hermetically sealed as a unit.

According to an aspect, the pouch 100 can include a liner element(s) on interior surfaces of the pockets 110. The liner element(s) can protect the foil laminate from damage caused by the elongated objects packaged within. The liner can be a corrugated polypropylene or other thermoplastic material. The liner element(s) may be inserted into the pockets 110 or may be affixed to the foil laminate material of the pouch 100.

Figure 2:
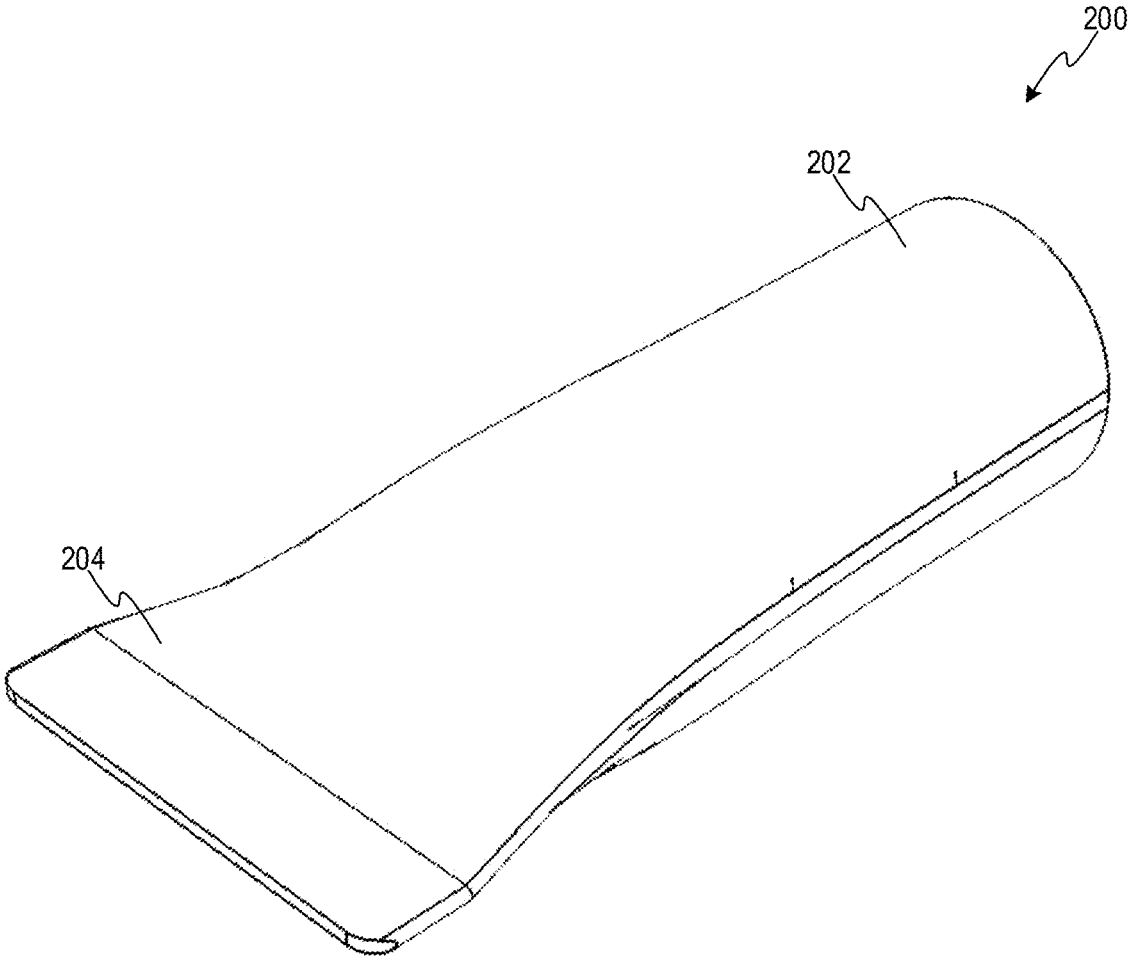
FIG. 2 illustrates an exemplary, non-limiting embodiment of a cap for application on an end of a bundle of one of more elongated objects for storage in the pouch of FIG. 1 in accordance with one or more aspects.
Figure 3:
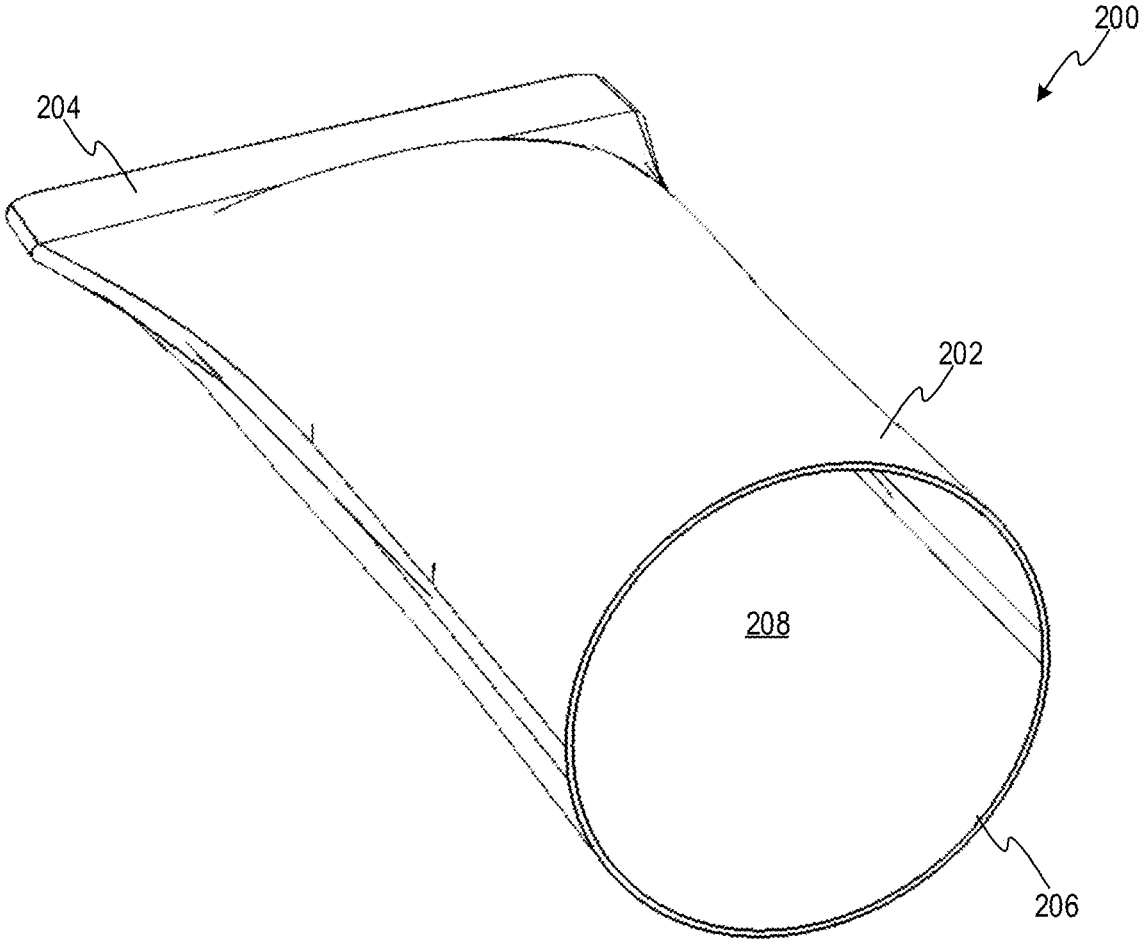
FIG. 3 illustrates an exemplary, non-limiting embodiment of a cap for application on an end of a bundle of one of more elongated objects for storage in the pouch of FIG. 1 in accordance with one or more aspects.
Figure 4:
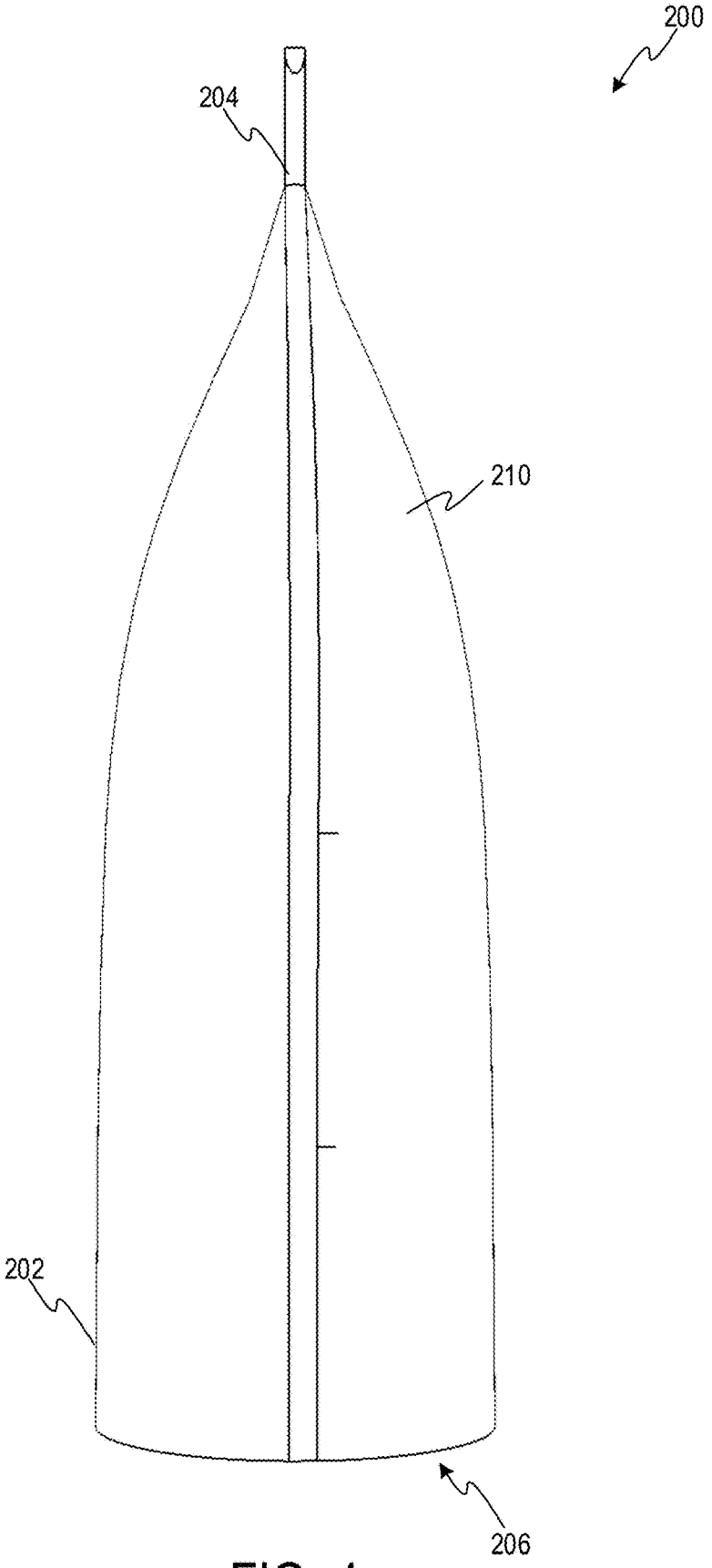
FIG. 4 illustrates an exemplary, non-limiting embodiment of a cap for application on an end of a bundle of one of more elongated objects for storage in the pouch of FIG. 1 in accordance with one or more aspects.

Turning now to FIGS. 2-4, an exemplary, non-limiting embodiment a liner element is depicted. According to this embodiment, the liner element includes a cap 200 for application on an end of a bundle of one of more elongated objects to be stored in a pocket 110 of the pouch 100. Cap 200 is configured to protect the foil laminate material of pouch 100 from damage caused by ends of the elongated objects, which may compromise an integrity of the hermetic sealing. Cap 200 can be employed alone or with additional liner elements coupled with the foil laminate of the pouch 100.

As shown in FIGS. 2-4, cap 200 can have a substantially cylindrical end 202 and a substantially flat end 204. The ends 202 and 204 are positioned at opposite ends along a length of the cap 200. The cylindrical end 202 can include an opening 206 into an interior volume 208 of the cap 200.

Figure 5:
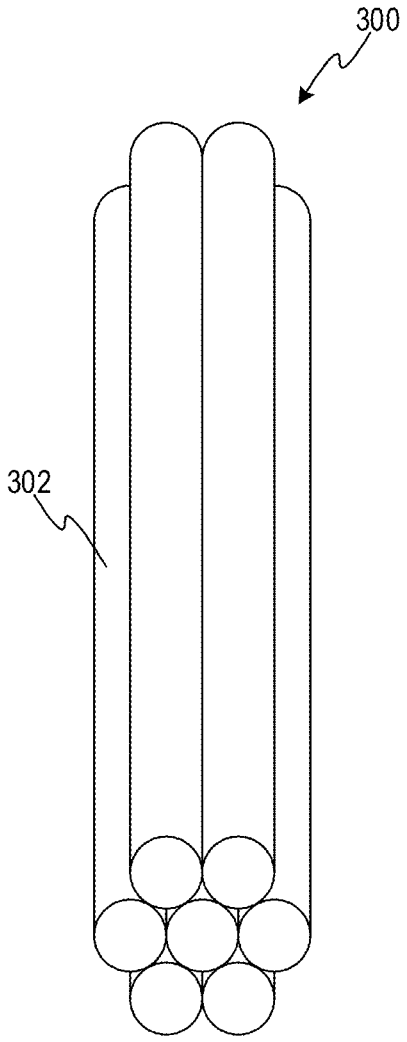
FIG. 5 illustrates an exemplary, non-limiting embodiment of a plurality of elongated objects for storage in the pouch of FIG. 1.

The cap 200 can be configured to receive a bundle of one or more elongated objects through opening 206 and at least partially into the interior volume 208. For example, the elongated objects can be a bundle 300 of stick electrodes 302 as shown in FIG. 5. For substantially cylindrical objects like electrodes 302, a generally hexagonal arrangement provides packing efficiency. The substantially cylindrical portion of interior volume 208, at which the bundle 300 is received, helps maintain this arrangement when the caps 200 are applied to both ends of the bundle 300. The arrangement depicted in FIG. 5 is merely exemplary and other arrangements of stick electrodes 302 are contemplated. For instance, a parallelogram or generally flatter arrangement can be utilized. With such an arrangement, electrodes 302 are arranged as a stack of rows, but each row is offset relative to adjacent rows similar to the offset shown in FIG. 5.

As best shown in FIG. 4, a transitional region 210 is located between the cylindrical end 202 and the flap end 204. When applied to bundle 300 and inserted into a pocket 110, the transitional region 210 helps prevent bunching of the foil laminate at the seal area.

Cap 200 can comprise a thermoplastic polymer material, such as but not limited to polypropylene. Moreover, the cap 200, and in particular the cylindrical end 202, can deform due to compression of the pocket when sealed. The deformation can facilitate securely maintain the packing arrangement of the elongated objects.

It is to be appreciated that cap 200 may be made from a flexible, resilient material such that material at end 202 around the opening 206 may sag or compress. Thus, cap 200, particularly when unloaded, may have substantially flatter appearance than shown in FIGS. 2-4. For instance, opening 206 may be noticeably elliptical. When cap 200 is positioned on a bundle 300 of elongated objects, the material of cap 200 around and near opening 206 may be forced outwards so that the cap 200 transitions to a shape similar to that shown in FIGS. 2-4.

Figure 6A:
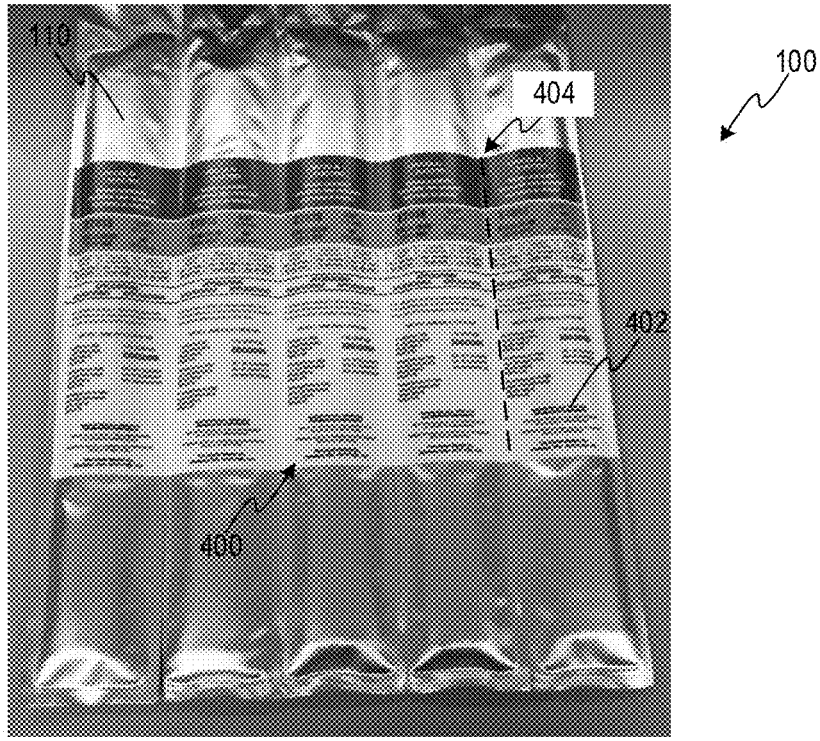
FIGS. 6*a* and 6*b* illustrate an exemplary, non-limiting embodiment of a label applied to the pouch of FIG. 1 according to an aspect.
Figure 6B:
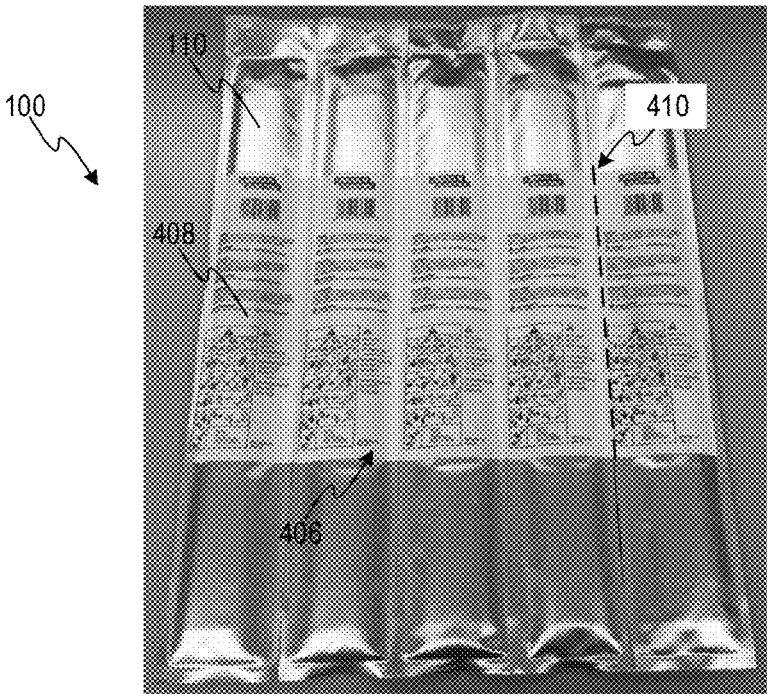

Turning now to FIGS. 6*a* and 6*b*, illustrated are exemplary, non-limiting embodiments of a label applied to the pouch 100. As shown in FIGS. 6*a* and 6*b*, the pouch 100 can be provided with a front label 400 and a back label 406 applied to opposing sides of the pouch 100. The labels 400, 406 can respectively include a plurality of sections 402, 408 delineated by perforations 404, 410. When applied to pouch 100 as shown, the sections 402, 408 align with corresponding pockets 110 of pouch 100. Further, perforations 404, 410 generally align with perforations along the longitudinal seals 108 such that individual pockets 110 bear label sections 402, 408 even when separated from pouch 100 for dispensing.

Figure 7:
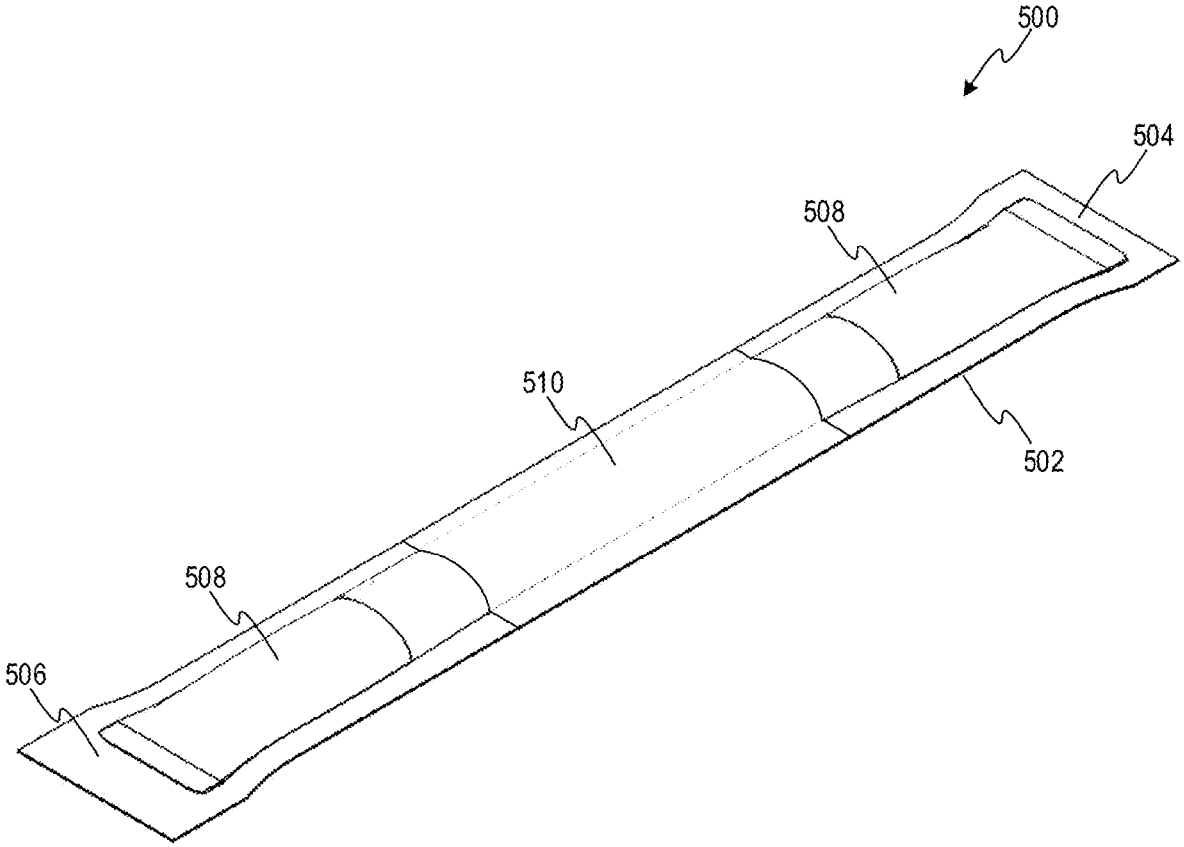
FIG. 7 illustrates an exemplary, non-limiting embodiment of an individual pocket separated from the pouch of FIG. 1 to an aspect.

FIG. 7 illustrates an exemplary, non-limiting embodiment of an individual pocket 500 separated from a master pouch or master body with product inserted and sealed therein. The pocket 500 includes a hermetic seal along longitudinal edge 502 extending between a first end 504 and a second end 506. The pocket 500 also includes hermetic seals at the first end 504 and the second end 506. Caps 508 (which can be similar to cap 200 described above) are applied to both ends of a bundle of product (e.g., a bundle of electrodes) prior to insertion of the bundle into the pocket 500. A label section 510 remains affixed to the pocket 500 even after separation from the master pouch.

In the embodiments above, exemplary packaging for elongated objects have been described. These embodiments are described in connection with small volume examples. However, these embodiment can be extended for higher volume packaging and filling. For instance, to accommodate filling larger volumes, a first sheet of pouch material may be rolled out over a base having a series of depressions. The sheet is rolled out in a direction aligned with the horizontal direction of the pouch 100 in FIG. 1. Bundles of elongated objects may be placed on to the first sheet. The bundles may carry caps (e.g. cap 200) on respective ends. The bundles may be placed in a spaced arrangement that corresponds to the series of depressions of the base. The bundles are placed orthogonally with respect to the direction in which the sheet was rolled.

After placement, a second sheet of pouch material may be rolled over and laid upon the first sheet and the bundles. Once rolled out, longitudinal seals (e.g. seals 108) may be formed between the placed bundles to separate the bundles and join the first and second sheets together. As described above, the seals may be perforated. Thereafter, both edges of the sheets may be sealed (e.g. corresponding to top seal 102 and bottom seal 104 of FIG. 1) to form individually, sealed pockets. The label may be applied to the pockets as an additional sheet. Alternatively, the pouch material may have a label printed thereon.

In one embodiment, an apparatus is described that includes a pouch with a plurality of longitudinal seals spaced at intervals in a transverse direction to define a plurality of individual pockets. The apparatus can further include a plurality of caps configured to be applied to both ends of a plurality of bundles of elongated objects. Each individual pocket of the pouch is configured to receive a respective bundle of elongated objects with respective caps prior to being hermetically sealed. The apparatus also includes a label applied to at least one side of the pouch, the label having a plurality of sections delineated by perforations.

According to an example, the pouch is a foil laminate material. Each cap of the plurality of caps can be a pinch tube and include a substantially cylindrical end, a substantially flat end, and an opening at the substantially cylindrical end through which the respective bundle of elongated objects is received. The plurality of caps can be made form a thermoplastic polymer.

In another example, each section of the label aligns with a corresponding pocket of the pouch. The longitudinal seals include perforations. The perforations of the label align with corresponding perforations of the longitudinal seals.

In another example, the apparatus can include a liner element within each individual pocket to protect a pouch material from abrasion. The liner element can be a made from a corrugated polypropylene.

In another embodiment, an apparatus for containing elongated objects is described. The apparatus can include a pouch of foil laminate having a plurality of longitudinal seals to define a plurality of pockets, each pocket respectively receives a bundle of elongated objects. The apparatus can further include a plurality of pairs of caps. Each pair of caps is respectively applied to both ends of a respective bundle of elongated objects prior to insertion into a respective pocket of the pouch. The open ends of the plurality of pockets are hermetically sealed as a unit after insertion of respective bundles of elongated objects bearing respective pairs of caps.

In an example, each cap includes a substantially cylindrical end, a substantially flattened end, and an opening at the substantially cylindrical end to an interior volume configured to partially receive an end of the respective bundle of elongated objects. The substantially cylindrical end of each cap compresses around the respective bundle of elongated objects upon hermetically sealing the pouch. Each cap can be made from a thermoplastic polymer.

In another example, a label can be applied to at least one side of the pouch. The label includes a plurality of sections such that each section of the label is associated with a respective pocket of the plurality of pockets. The longitudinal seals of the pouch are perforated to enable individual separation of one or more pockets of the plurality of pockets without compromising a hermetic seal. The plurality of sections of the label are delineated by perforations. The perforations of the label align with the perforations of the pouch. Each section of the label displays identical information and remains affixed to the respective pocket of the pouch when the respective pocket is separated from the pouch.

In yet another embodiment, a pouch for welding electrodes is described. The pouch can include two sheets of foil laminate material initially sealed together along three edges to form a master body. The pouch can also include a plurality of longitudinal seals formed on the master body at spaced intervals and orthogonal to an initial unsealed edge of the master body to form a plurality of individual pockets. The pouch can also include a plurality of caps adapted to fit over ends of respective bundles of welding electrodes. Each individual pocket is adapted to receive a bundle of welding electrodes with caps applied. The pouch also includes a label applied to at least one side of the master body. The label includes a plurality of sections respectively associated with the plurality of individual pockets. According to an example, the plurality of longitudinal seals and the label are perforated such that respective perforations align when the label is applied.

The above examples are merely illustrative of several possible embodiments of various aspects of the present invention, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (e.g., that is functionally equivalent), even though not structurally equivalent to the disclosed structure which performs the function in the illustrated implementations of the invention. In addition although a particular feature of the invention may have been disclosed with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising."

This written description uses examples to disclose the invention, including the best mode, and also to enable one of ordinary skill in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that are not different from the literal language of the claims, or if they include equivalent structural elements with insubstantial differences from the literal language of the claims.

The best mode for carrying out the invention has been described for purposes of illustrating the best mode known to the applicant at the time. The examples are illustrative only and not meant to limit the invention, as measured by the scope and merit of the claims. The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof

What is claimed is:

1. An apparatus, comprising:

a pouch with a plurality of longitudinal seals spaced at intervals in a transverse direction to define a plurality of individual pockets;

a plurality of caps configured to be applied to both ends of a plurality of bundles of elongated objects, wherein each individual pocket of the pouch is configured to receive a respective bundle of elongated objects with respective caps prior to being hermetically sealed; and a label applied to at least one side of the pouch, the label having a plurality of sections delineated by perforations, wherein the longitudinal seals include perforations, and wherein the perforations of the label align with corresponding perforations of the longitudinal seals.

2. The apparatus of claim 1, wherein the pouch comprises a foil laminate material.

3. The apparatus of claim 1, wherein each cap of the plurality of caps is a pinch tube comprising:

a substantially cylindrical end;

a substantially flat end; and an opening at the substantially cylindrical end through which the respective bundle of elongated objects is received.

4. The apparatus of claim 1, wherein each section of the label aligns with a corresponding pocket of the pouch.

5. The apparatus of claim 1, further comprising a liner element within each individual pocket to protect a pouch material from abrasion.

6. The apparatus of claim 5, wherein the liner element comprises corrugated polypropylene.

7. The apparatus of claim 1, wherein the plurality of caps comprises a thermoplastic polymer.

8. An apparatus for containing elongated objects, comprising:

a pouch of foil laminate having a plurality of longitudinal seals to define a plurality of pockets, each pocket respectively receives a bundle of elongated objects; and a plurality of pairs of caps, wherein each pair of caps is respectively applied to both ends of a respective bundle of elongated objects prior to insertion into a respective pocket of the pouch, wherein open ends of the plurality of pockets are hermetically sealed as a unit after insertion of respective bundles of elongated objects bearing respective pairs of caps, wherein the longitudinal seals of the pouch are perforated to enable individual separation of one or more pockets of the plurality of pockets without compromising a hermetic seal, wherein the plurality of sections of the label are delineated by perforations, and wherein the perforations of the label align with the perforations of the pouch.

9. The apparatus of claim 8, wherein each cap comprises:

a substantially cylindrical end;

a substantially flattened end; and an opening at the substantially cylindrical end to an interior volume configured to partially receive an end of the respective bundle of elongated objects.

10. The apparatus of claim 9, wherein the substantially cylindrical end of each cap compresses around the respective bundle of elongated objects upon hermetically sealing the pouch.

11. The apparatus of claim 8, wherein each cap comprises a thermoplastic polymer.

12. The apparatus of claim 8, further comprising a label applied to at least one side of the pouch, wherein the label includes a plurality of sections such that each section of the label is associated with a respective pocket of the plurality of pockets.

13. The apparatus of claim 12, wherein each section of the label displays identical information and remains affixed to the respective pocket of the pouch when the respective pocket is separated from the pouch.

14. A pouch for welding electrodes, comprising:

two sheets of foil laminate material initially sealed together along three edges to form a master body;

a plurality of longitudinal seals formed on the master body at spaced intervals and orthogonal to an initial unsealed edge of the master body to form a plurality of individual pockets;

a plurality of caps adapted to fit over ends of respective bundles of welding electrodes, each individual pocket being adapted to receive a bundle of welding electrodes with caps applied; and a label applied to at least one side of the master body, the label having a plurality of sections respectively associated with the plurality of individual pockets, wherein the plurality of longitudinal seals and the label are perforated such that respective perforations align when the label is applied.

* * * * *